US005758536A

United States Patent [19]

Jeong

[11] Patent Number: 5,758,536

[45] Date of Patent: Jun. 2, 1998

[54] DEVICE AND METHOD FOR COLD FORGING DOUBLE CYLINDRICAL PULLEY

[75] Inventor: Deok Jin Jeong, Kyungaangtuk-do, Rep. of Korea

[73] Assignee: Poongsan Corporation, Kwangyeok-si, Rep. of Korea

[21] Appl. No.: 662,651

[22] Filed: Jun. 13, 1996

[51] Int. Cl.[6] ..... B21D 22/00

[52] U.S. Cl. ..... 72/359; 72/358; 72/354.6

[58] Field of Search ..... 72/359, 358, 377, 72/352, 354.6, 354.8, 355.2; 474/902, 903, 171, 174

[56] References Cited

U.S. PATENT DOCUMENTS

| | | | |
|---|---|---|---|
| 2,493,053 | 1/1950 | Zatyko | 474/174 |
| 2,966,987 | 1/1961 | Kaul | 72/359 |
| 3,200,630 | 8/1965 | Wilson | 72/267 |
| 4,847,968 | 7/1989 | Shirai et al. | 72/359 |

*Primary Examiner*—Lowell A. Larson
*Assistant Examiner*—Rodney Butler
*Attorney, Agent, or Firm*—Jacobson, Price, Holman & Stern, PLLC

[57] ABSTRACT

Method for forming a double cylindrical pulley, in which a work piece placed in a die is pressed by a punch to cause the work piece to make a plastic deformation, for forming an inner ring and an outer ring of the pulley to have the same hardnesses and lengths, and a device suitable for forming the same, is disclosed, the method including: the steps of placing a piece of raw material on a counter punch mounted in a die of a built up metal mold; and, lowering a punch onto the piece of raw material, whereby the piece of raw material is caused to make a plastic deformation so that the piece of raw material flows into spaces between the die and counter punch to form an inner ring part and an outer ring part, and a flow of the material toward the outer ring part is controlled by a step part formed on the die to form an extended tip part, and the inner ring part and the outer ring part to have the same lengths and hardness: and the device including a die for placing a piece of raw material thereon; a counter punch mounted in the die for forming an inner space and an outer space which are spaces for forming an inner ring part and an outer ring part respectively; a punch for pressing the piece of raw material to cause the raw material to make a plastic deformation; and, a step part on the die for reducing speed of an outwardly flow of the raw material and forming an extended tip part on the pulley at pressing the piece of raw material.

2 Claims, 3 Drawing Sheets

DEVICE AND METHOD FOR COLD FORGING DOUBLE CYLINDRICAL PULLEY

BACKGROUND OF THE INVENTION

The present invention relates to a double cylindrical pulley for use in products, such as automobile air conditioner clutch, more particularly to a method for forming a double cylindrical pulley, in which a work piece placed in a die is pressed by a punch to cause the work piece to make a plastic deformation, for forming an inner ring and an outer ring of the pulley to have the same hardnesses and lengths, and a device suitable for forming the same.

As shown in FIGS. I and 2, the double cylindrical pulley 1 has a disk part 2, an inner ring part 3 and an outer ring part 4, of which lengths of the inner ring part and the outer ring part should be the same in case it is used as a special purpose pulley for use in, such as an air conditioner clutch.

And, as shown in FIG. 2, the double cylindrical pulley may have an opening 6 of a predetermined size at its center.

In order to form such a double cylindrical pulley conventionally, at first, a disk of a predetermined thickness is hot or cold forged into an intermediate product, which is then cold forged into a final product.

However, in case the pulley is formed by forming the intermediate product and the cold forging of the intermediate product, hardness of the pulley is not uniform.

That is, in case the intermediate product is formed by hot or cold forging, in which the inner ring part is formed to a length about 10~20 mm in advance, the intermediate product (which has a hardness substantially the same with a raw material) is annealed as a preparation for the cold forging or cold forged as it was hot forged(which has a low hardness, which cold forging causes, depending on an amount of deformation, i.e., strain of the intermediate product, the pulley to have parts with a higher hardness coming from a great amount deformation and parts with a lower hardness coming from a small amount of deformation.

In other words, as the part forged in advance in the intermediate product stage, which is not deformed at the final cold forging, has a low hardness, and the part which has not been forged in advance(the part to be forged in the second forging) has a high hardness, the pulley is caused to have non-uniform hardness.

And, the annealing process causes the manufacturing process increase, that pushes up the production cost.

SUMMARY OF THE INVENTION

The object of the present invention is to provide a method and device for forming a pulley having an inner ring part and an outer ring part of which lengths are the same by cutting raw material and a direct forward extrusion of the cut raw material without forming the intermediate product.

In one aspect of the invention to achieve the object, there is provided a method for manufacturing a double cylindrical pulley, including the steps of placing a piece of raw material on a counter punch mounted in a die of a press mold, and lowering a punch onto the piece of raw material, whereby the piece of raw material is caused to make a plastic deformation so that the piece of raw material flows into spaces between the die and counter punch to form an inner, and outer ring parts, and a flow of the material toward the outer ring part is controlled by a step part on the die to form the inner, and outer ring parts to have the same length and an extended tip part.

In other aspect of the present invention to achieve the object, there is provided a device for cold forging a double cylindrical pulley, including a die for placing a piece of raw material thereon, a counter punch mounted in the die for forming an inner space and an outer space which are spaces for forming an inner ring part and an outer ring part respectively, a punch for pressing the piece of raw material to cause a plastic deformation, and a step part on the die for reducing speed of an outwardly flow of the material at pressing the piece of raw material.

BRIEF DESCRIPTION OF THE DRAWINGS

FIGS. **6*a* and 6*b* illustrate enlarged views of the pair of molds in FIG. 5 in accordance with the present invention, wherein.

DETAILED DESCRIPTION OF THE INVENTION

One preferred embodiment of the present invention will now be explained in detail in association with the attached drawings.

Figure 1A:
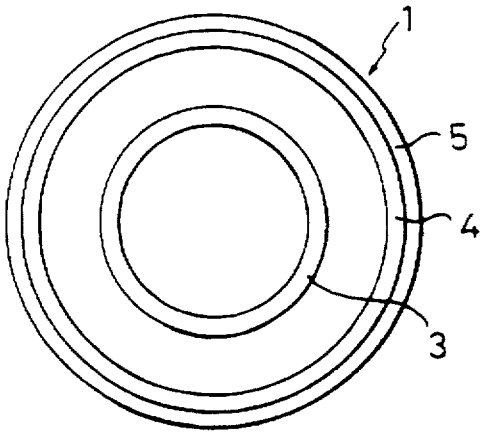
FIG.1A prior art
FIG. 1 illustrates a plan, and sectional views of a double cylindrical pulley with no opening.
Figure 2A:
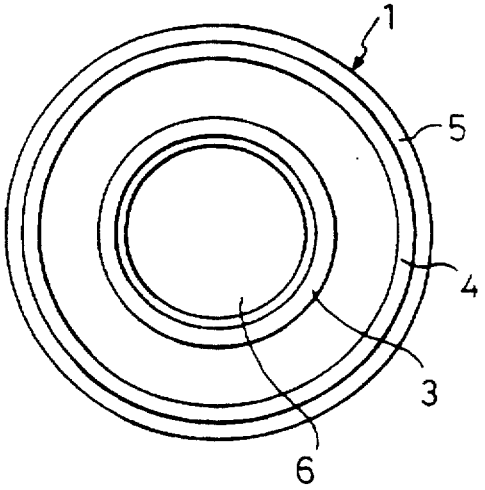
FIG.2A prior art
FIG. 2 illustrates a plan, and sectional views of a double cylindrical pulley with an opening.
Figure 1B:
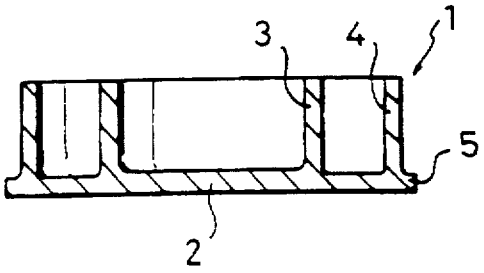
FIG.1B prior art
Figure 2B:
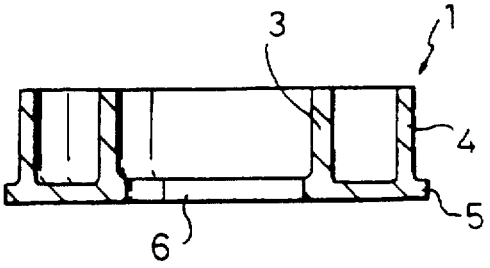
FIG.2B prior art
Figure 3:
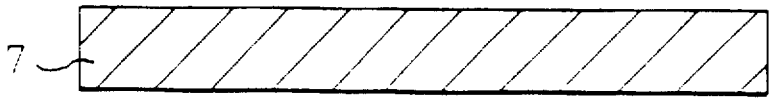
FIG.3 prior art
FIG. 3 illustrates a section of a piece of raw material for forging into a double cylindrical pulley with no opening.
Figure 4:
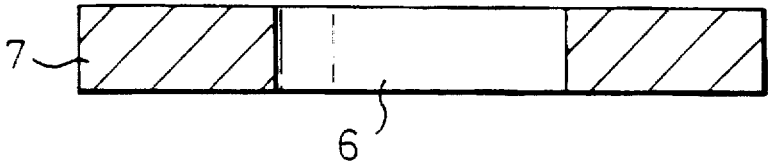
FIG.4 prior art
FIG. 4 illustrates a section of a piece of raw material for forging into a double cylindrical pulley with an opening.

FIGS. 3 and 4 illustrate sections of pieces of raw material for forging double cylindrical pulleys with and without an opening respectively, wherein each of the pieces of raw material 7 has a form of disk with a predetermined thickness, of which one shown in FIG. 4 has an opening.

The opening in the piece of raw material makes a reduction of about 20% of forging load and about 30% of stress in the metal mold compared to the piece of raw material without the opening in a cold forging, but makes no difference in the way of cold forging.

Figure 5:
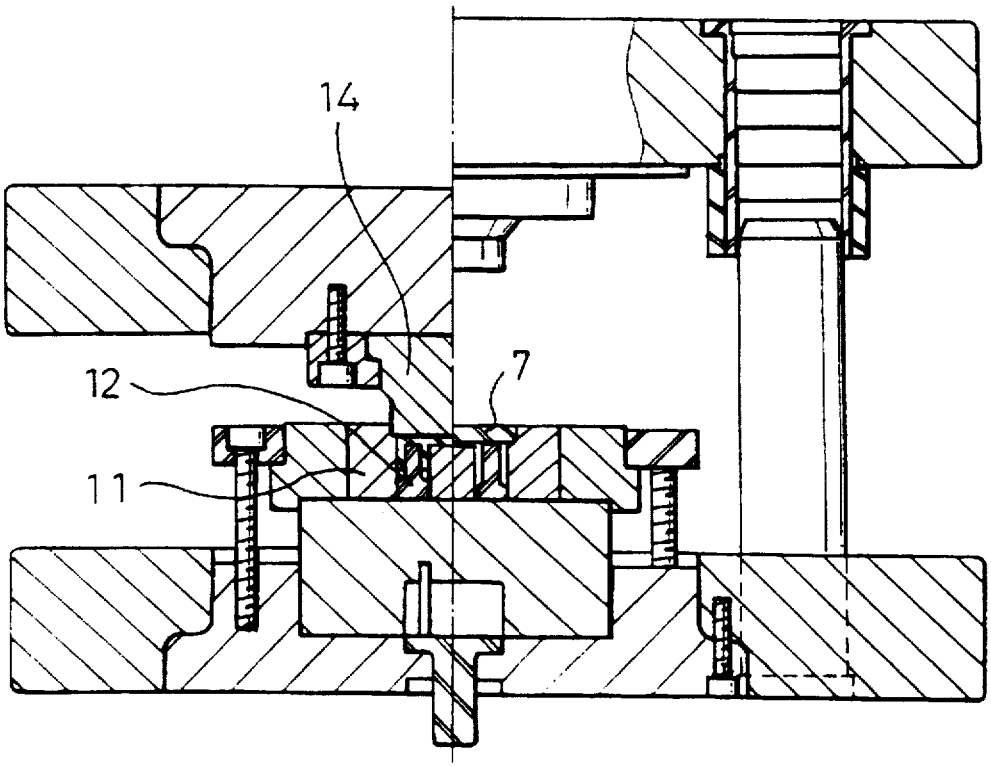
FIG. 5 illustrates a section of a pair of molds showing a device in accordance with the present invention.
Figure 6A:
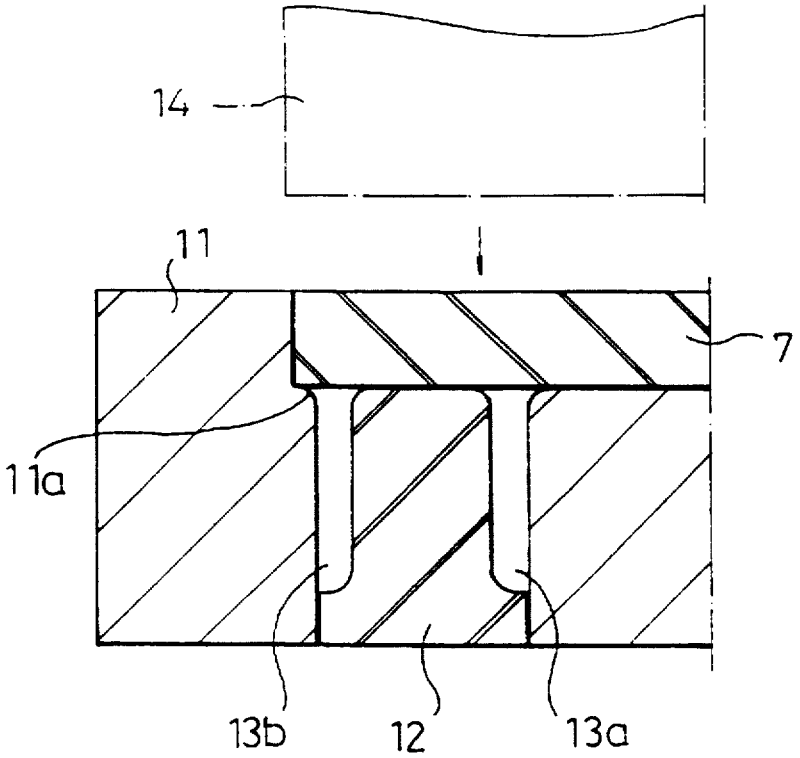
FIG. 6*a* shows before molding.
Figure 6B:
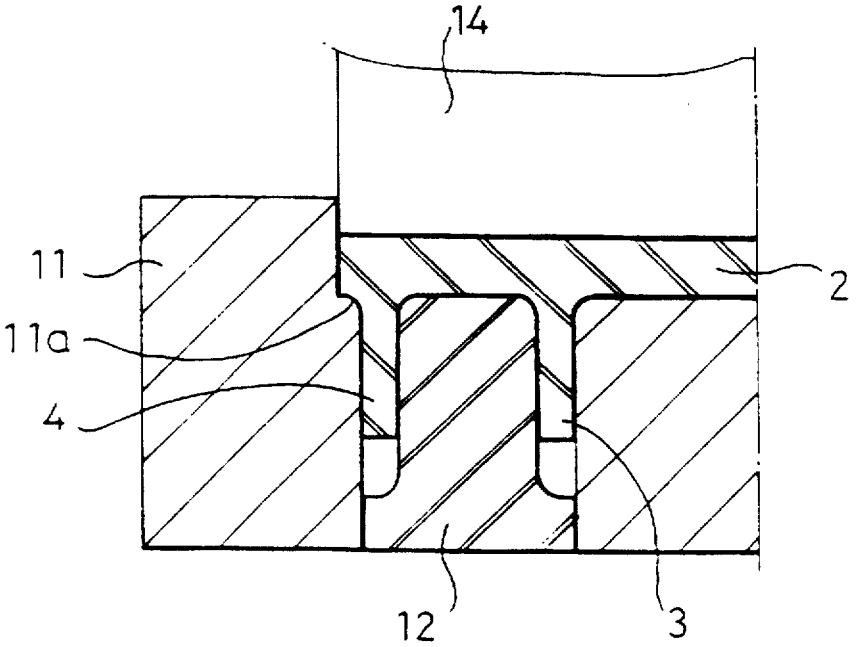
FIG. 6*b*** shows after the molding.

FIGS. 5, **6*a* and 6*b* show sections of a pair of mold in accordance with the present invention, including a die 11 for placing a piece of raw material 7 thereon, a counter punch 12 mounted in the die for forming an inner space 13*a* and an outer space 13*b* which are spaces for forming an inner ring part and an outer ring part respectively, and a punch 14** for pressing the piece of raw material.

The die 11 includes a die ring of a structural alloy steel provided in an outer side of the die for sustaining an external expansion stress coming from forming force at the forging of the raw material and prevention of breakage due to the expansion stress, and a die inset of a too steel which can sustain the forming force, which are coupled by a heated fit for reinforcement.

The die serves a smooth formation of the product in formation of the outer ring part 4 of the pulley 1 by means of a land part and a relief angle provided thereon, and the inner ring part 3 and the outer ring part 4 formed to have the same lengths by controlling a flow of metal during forging the piece of raw material.

That is, the faster and greater amount of metal flow to the outer ring part than the inner ring part during pressing the piece of raw material has caused the outer ring part formed longer than the inner ring part. However, the die in accordance with the present invention has a step 11*a* for reducing outwardly speed of the raw material in the die, which results in the inner, and outer ring parts formed to the same lengths.

The punch 14, lowered by means of a mechanical or hydraulic device, serves to deliver a forming force to the piece of raw material to make a plastic deformation.

Accordingly, upon lowering and pressing an upper ram of the mechanical or hydraulic device onto the piece of raw material with or without an opening put into the die 11 and mounted on the counter punch 12, the piece of raw material, getting out of its elastic region and coming into its plastic region, starts to make a plastic deformation causing flow of metal.

The flow of metal, which is faster in the outer ring part 4 than in the inner ring part 3, is reduced when an outwardly metal flow hits the step part 11*a* formed on the die 11, resulting in the lengths of the inner ring part and the outer ring part formed the same.

That is, the step part 11*a* on the die 11 causes the extended tip part 5 formed at outer part of the outer ring part 4, which extended tip part 5 reduces a speed of the metal flow toward the outer ring part 4 to form the lengths of the inner, and outer ring parts 3 and 4 the same.

A size of the step is set to an appropriate length depending on a size of the pulley or properties of the metal.

Although the invention has been described in conjunction with specific embodiments, it is evident that many alternatives and variations will be apparent to those skilled in the art in light of the foregoing description. Accordingly, the invention is intended to embrace all of the alternatives and variations that will fall within the spirit and scope of the appended claims.

What is claimed is:

1. A method for cold forging a double cylindrical pulley comprising the steps of:

placing a piece of raw material on a counter punch mounted in a die of a built up metal mold;

forming a step part on the die for reducing speed of an outward flow of the raw material and for forming an extended tip part on the pulley; and lowering a punch onto the piece of raw material, wherein the piece of raw material is caused to make a plastic deformation so that the piece of raw material flows into spaces between the die and the counter punch to form an inner ring part and an outer ring part, and the step part controls a flow of the material toward the outer ring part so that the inner ring part and the outer ring part have the same lengths and hardness.

2. A device for cold forging a double cylindrical pulley comprising:

a die for placing a piece of raw material thereon;

a counter punch mounted in the die for forming an inner space and an outer space which are spaces for forming an inner ring part and an outer ring part respectively;

a punch for pressing the piece of raw material to cause the raw material to make a plastic deformation; and a step part on the die for reducing speed of an outward flow of the raw material and forming an extended tip part on the pulley during pressing the piece of raw material, wherein the step part controls a flow of the material toward the outer ring part so that the inner ring part and the outer ring part have the same lengths and hardness.

* * * * *